United States Patent [19]

Haver

[11] 4,188,737

[45] Feb. 19, 1980

[54] SPORT SHOES

[75] Inventor: Sanford A. Haver, New York, N.Y.

[73] Assignee: Colgate-Palmolive Company, New York, N.Y.

[21] Appl. No.: 922,693

[22] Filed: Jul. 7, 1978

[51] Int. Cl.[2] ..... A43B 5/00; A43B 23/00

[52] U.S. Cl. ..... 36/131; 36/137

[58] Field of Search ..... 36/131, 137; 350/98

[56] References Cited

U.S. PATENT DOCUMENTS

| | | | |
|---|---|---|---|
| 2,607,130 | 8/1952 | Pearson | 36/137 |
| 3,952,428 | 4/1976 | Polsky | 36/131 |

FOREIGN PATENT DOCUMENTS

| | | | |
|---|---|---|---|
| 2301193 | 2/1975 | France | 36/131 |
| 1685 | of 1893 | United Kingdom | 36/131 |

*Primary Examiner*—Patrick D. Lawson

*Attorney, Agent, or Firm*—Herbert S. Sylvester; Murray M. Grill

[57] ABSTRACT

There is disclosed a sport shoe having an outsole adapted and constructed to provide means for assisting in engaging a bicycle pedal. In the various embodiments disclosed the outsole possesses one or more transverse recesses into which may be fitted a bicycle pedal. The outsole in one embodiment has two transverse recesses so that a wearer of the shoe may selectively employ one of the recesses. In another embodiment the outsole has a single recess and, additionally, a forwardly facing shoulder at the toe portion for a bicycle pedal. The sport shoe may be desirably fitted with reflective means, preferably at the counter portion of the shoe or the rearwardly facing heel portion and/or at the forwardly facing toe portion in order to increase the visibility of a bicycle rider, especially at night.

8 Claims, 6 Drawing Figures

SPORT SHOES

BACKGROUND OF THE INVENTION

It will be noted hereinafter that the present invention relates to an article of footwear, and, more particularly, to shoes worn while riding bicycles.

Heretofore, it has been conventional practice to provide bicycle shoes with detachable soles, as indicated in U.S. Pat. No. 472,214, with soles of composite construction, as indicated in U.S. Pat. No. 468,223, and in flexible molded shoes having indentations therein as indicated in U.S. Pat. No. 3,114,981. Of course, it has been conventional practice to provide attachments for pedals of bicycles designed to retain the foot onto the pedal, as in U.S. Pat. No. 590,685 and 598,325.

Furthermore, it is well known among devotees of the sport of cycling that a cyclist's performance can be improved by the use of specially constructed bicycling shoes which have cleats attached to their bottom surfaces. The corresponding pedal structures of the bicycle typically engages the cleat to prevent undesired side-to-side or front-to-back motion of the shoe relative to the pedal and often includes a toe clip that sweeps over the top of the shoe. This arrangement allows the cyclist to pedal more vigorously without fear that his or her feet will become disengaged from the pedals and that time will be lost in regaining the proper position. The interlock between the cleat and the pedal permits the rider to thrust the pedal forward with great force along the top of the stroke and backward with greater force along the bottom of the stroke. When a toe clip is provided, it enables the rider to pull the pedal upwardly on the back half of the stroke as the opposite pedal is pushed downwardly. The improvement in speed and stamina that can be obtained in this way is substantial.

There are, however, disadvantages associated with cleated bicycling shoes that have prevented them from gaining wider acceptance. The cleats, which generally extend under the ball of the foot, make it difficult to walk in the shoes after the bicycle has been dismounted. When walking is unavoidable, the cleats may be worn or damaged and can easily deface floors and other surfaces. In addition, the cleats being small tend to catch or slip on hard surfaces and are therefore quite dangerous.

While the disadvantages of cleated bicycling shoes are not as significant an inconvenience to racers, they are a great problem to cyclists traveling long distances who wish to leave their bicycles at various points along the way. A particularly difficult problem is presented if the bicycle should break down, since walking long distances on the cleats is uncomfortable and sometimes impossible. Since cyclists wish to pack as little gear as possible, they generally object to the bulk and weight of an extra pair of shoes to be carried just for walking.

SUMMARY OF THE INVENTION

The present invention is to provide an improved bicycle shoe in which the outsole design enables the rider's shoe to engage the pedal and hold it in place while riding the bicycle. In one embodiment there is provided an improved bicycle shoe in which the outsole includes at least two recessed portions between the heel and toe portions having a dimension slightly larger than the surface of the pedal. In another embodiment the one recess is provided between the heel portion and the toe portion. However, in this embodiment the toe portion constitutes a transverse shoulder at a dimension to provide a good toe hold with the pedal.

In each embodiment, the shoe is provided with a heel. Additionally the non-recessed portion of the outsole between either the two recesses in one embodiment or the single recess and the shoulder of the toe portion is sufficiently large and is positioned conveniently whereby the wearer is given sufficiently comfortable support to enable the wearer to dismount the bicycle and to walk relatively easily and with comfort; thereby obviating the need for a second pair of shoes when the rider wishes to walk.

It is also contemplated that the shoe of the present invention be fitted with light reflector means whereby the rider presents increased visibility to motorized traffic when the headlight beams of automobiles strike the reflectors. The reflectors may be adhesively secured to the rear portion of the shoe and/or the toe portion. An acceptable means of such an arrangement can be seen in the U.S. patent to Pearson, U.S. Pat. No. 2,607,130, which is incorporated herein by reference.

BRIEF DESCRIPTION OF THE DRAWINGS

Preferred embodiments of the invention have been chosen for purposes of illustration and description which are shown in the accompanying drawings, forming a part of the specification, wherein.

DETAILED DESCRIPTION OF THE PREFERRED EMBODIMENTS

Figure 1:
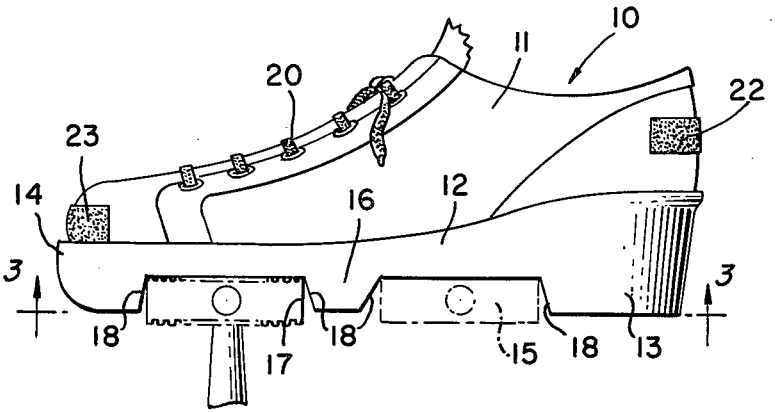
FIG. 1 is a side elevational view of the shoe of the present invention with a pedal in position in one of the recesses.

Referring now to FIGS. 1 to 6 of the drawings in detail, there is shown two embodiments of a shoe 10 for use particularly in pedalling a bicycle (not shown), while at the same time being useful in walking, hiking and playing in sports.

The shoe 10 includes an upper 11 and an outsole 12, preferably of composition material to provide lightness in weight, being formed with a heel 13 an a toe portion 14. The outsole is preferably constructed as one piece although it is within the purview of the invention to construct the outsole of laminated materials and the like. When the outsole is constructed of one piece, it may be conveniently manufactured by conventional molding techniques. The outsole may be constructed by lateral extrusion of a web which is then subjected to die cutting techniques whereby the outsoles are stamped out in a side by side fashion.

The outsole is secured to the upper by conventional means, such as by the use of some of the new hot melt adhesives being employed for such purposes.

Figure 2:
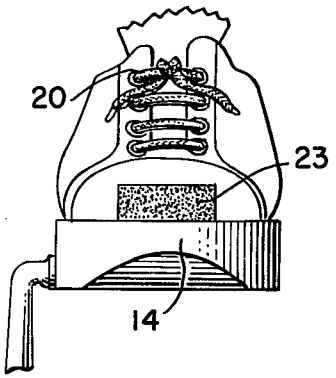
FIG. 2 is a front view of the embodiment of FIG. 1.
Figure 3:
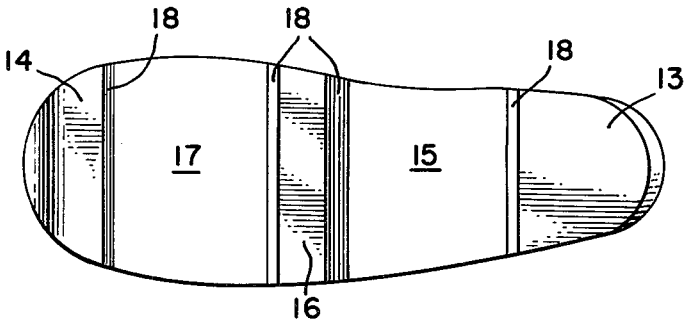
FIG. 3 is a bottom view of the embodiment taken along plane 3—3 of FIG. 1.
Figure 5:
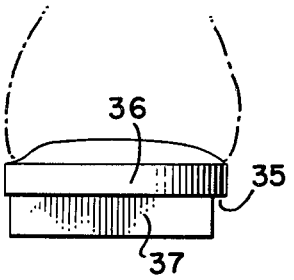
FIG. 5 is a front view of the embodiment of FIG. 4.
Figure 4:
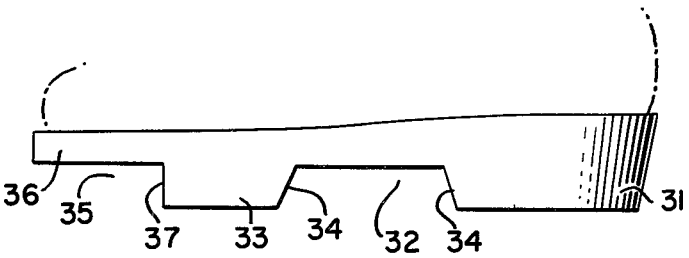
FIG. 4 is a side view of the sole 4 of another embodiment wherein the shoe upper is fragmentary and shown in dotted lines.
Figure 6:
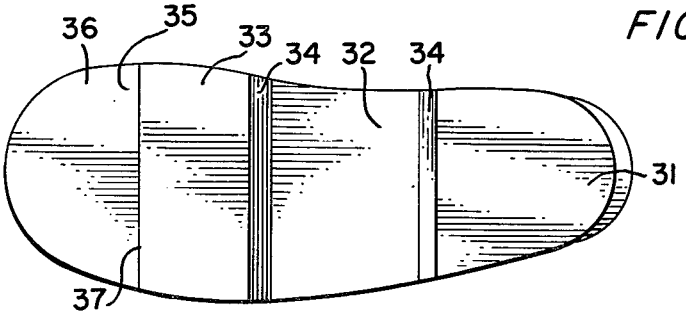
FIG. 6 is a bottom view of the embodiment of FIGS. 4 and 5.

The outsole 12 of FIGS. 1–3 possesses two transverse recesses. One recess 15 is defined by the forward portion of heel 13 a portion 16 located essentially under the instep portion of the foot and which is not recessed. The second recess 17 is defined by the toe portion 14 and the other side of the portion 16 under the instep of the foot which may also be referred to as a bridging portion.

The width of the two recesses must be sufficient to embrace at least the forward to back width of the conventional pedal. It will be noted in FIG. 1 that a pedal is seen to be resting in recess 17, the roof thereof being at least sufficiently large to encompass the pedal. The pedal is depicted in recess 15 by dotted lines as seen in FIG. 1. It will be appreciated that the side walls 18 of the recesses slope inwardly upwardly. This provides for easy engagement for the pedals but more importantly for easy disengagement which may be necessary to accomplish rapidly on occasion.

The shoe has an upper 11 which may be of a conventional type that has a conventional lacing arrangement 20. On the other hand it may be closed by buckled straps and the like.

The shoe will be seen to possess an additional feature which fulfills a safety feature. In regard thereto, a strip of light reflecting tape 22, conventional in the art. At the same time it has also been found desirable to attach a similar tape 23 to the front of the shoe on the forwardly facing toe portion. The rearwardly reflector may be red while the forwardly facing tape may be white, yellow or red as desired. The tape may be fabricated of a layer of tiny glass beads adhesively secured to a substrate as is well known in the art. Also the tape may be coated with a dye that emits light when subjected to UV radiation so that it will provide greater visibility during daylight as well as fulfilling its function of providing visibility through reflection of light from the headlights of on coming automobiles.

The shoe of the present invention provides little discomfort when used for walking. Of course the heel portion provides the usual support. There is sufficient ground or surface engaging outsole between the toe portion 14 and the bridging portion 16 and the outsole is sufficiently rigid so that the absence of ground or surface engaging outsole at the forward recess 17 is not particularly noticeable.

Now attention is directed to the second embodiment as depicted by FIGS. 3-6. It will be noted that the shoe is provided with an outsole 30 having a different configuration. The heel 31 of the outsole is larger. Forward thereof is a recess 32 which is positioned somewhat more forward than in the other embodiment. Again the recess 32 is of a sufficient dimension to accommodate a pedal as heretofore stated. Forward of the recess is a surface or ground engaging portion 33 which defines the other side of the recess 32. Again, inwardly upwardly sloping walls 34 are provided to provide easy access to the recess. Forward of the surface or ground engaging portion 33 is a shoulder or cutaway portion 35 which is also part of the toe portion 36. The wall 37 of the shoulder portion 35 is essentially perpendicular to provide maximum engaging configuration with the rearwardly facing portion of a pedal. The approach to the engagement of the pedal is different when resting in the shoulder portion than when the pedal is inserted into the recesses by the rider.

As the ground engaging portion is directly under the ball of the foot of the wearer and is of a dimension that is sufficiently large, the wearer is given good support between the heel 31 and the said ground engaging portion 33.

As before, light reflector means may be applied to appropriate surfaces.

While the shoe of this invention is particularly adapted to bicycle pedalling, it can also be used for other purposes, such as walking, hiking, and playing in various sports. From the foregoing description it will be seen that the present invention provides an improved shoe which is particularly adapted for safe bicycle pedalling but is useful as well for other purposes.

As various changes may be made in the form, construction, and arrangement of the parts herein, without departing from the spirit and scope of the invention and within sacrificing any of its advantages, it is to be understood that all matters are to be interpreted as illustrative and not in any limiting sense.

What is claimed is:

1. A shoe for use in propelling bicycles equipped with pedals, said shoe comprising, in combination:

(a) an upper portion adapted and constructed to encompass a foot;

(b) an outsole secured to said upper portion;

(c) said outsole having a heel portion;

(d) said outsole having a toe portion;

(e) said outsole having at least one transverse recess disposed between said heel portion and said toe portion extending completely from side to side of the outsole adapted and constructed to encompass at least a portion of an upwardly facing pedal;

(f) said recess having transverse upwardly converging sloping walls terminating in a longitudinally connecting flat portion.

2. The shoe of claim 1 wherein said outsole has two transverse recesses between said toe portion and said heel portion.

3. The shoe of claim 2 wherein each of said recesses are adapted and constructed to encompass at least a portion of an upwardly facing pedal.

4. The shoe of claim 3 wherein each of said recesses have transverse upwardly inwardly sloping walls.

5. The shoe of claim 1 wherein said shoe has light reflecting means secured thereto.

6. The shoe of claim 1 wherein said shoe has light reflecting means secured thereto.

7. A shoe for use in propelling bicycles equipped with pedals, said shoe comprising, in combination:

(a) an upper portion adapted and constructed to encompass a foot;

(b) an outsole secured to said upper portion;

(c) said outsole having a heel portion;

(d) said outsole having a toe portion;

(e) said outsole having two transverse recesses disposed between said heel portion and said toe portion extending completely from side to side of the outsole each adapted and constructed to encompass at least a portion of an upwardly facing pedal;

(f) said recess having transverse upwardly inwardly sloping walls.

(g) the two recesses are separated by a ground engaging portion which is positioned under the instep of the foot of a wearer of the shoe.

8. A shoe for use in propelling bicycles equipped with pedals, said shoe comprising, in combination:

(a) an upper portion adapted and constructed to encompass a foot;

(b) an outsole secured to said upper portion;

(c) said outsole having a heel portion;

(d) said outsole having a toe portion having a forwardly facing cut away portion adapted and constructed to overlie a major portion of an upwardly facing surface of a pedal;

(e) said outsole having a transverse recess disposed between said heel portion and said toe portion extending completely from side to side of the outsole adapted and constructed to encompass at least a portion of an upwardly facing pedal;

(f) said recess having transverse upwardly converging sloping walls;

(g) said recess and the said cut away portion being separated by a ground engaging portion which is positioned under the ball of the foot of a wearer of the shoe and is of longitudinal dimension to support at least a major portion of the ball portion of the foot of the wearer of the shoe.

* * * * *